US005326126A

United States Patent [19]

Ruffinengo

[11] Patent Number: 5,326,126

[45] Date of Patent: Jul. 5, 1994

[54] MODIFICATION OF THE FLEXIBILITY OF SKIS

[76] Inventor: Piero G. Ruffinengo, 820 Edgehill Rd., Salt Lake City, Utah 84103

[21] Appl. No.: 114,212

[22] Filed: Aug. 30, 1993

Related U.S. Application Data

[60] Division of Ser. No. 900,604, Jun. 18, 1992, Pat. No. 5,269,555, which is a continuation-in-part of Ser. No. 715,598, Jun. 14, 1991, Pat. No. 5,251,923, and a continuation-in-part of Ser. No. 828,140, Jan. 30, 1992, Pat. No. 5,280,942.

[51] Int. Cl.[5] ..... A63C 5/075

[52] U.S. Cl. ..... 280/602; 280/607; 280/618

[58] Field of Search ..... 280/602, 607, 616, 617, 280/618, 601, 634

[56] References Cited

U.S. PATENT DOCUMENTS

| | | | |
|---|---|---|---|
| 2,258,046 | 10/1941 | Clement | 280/11.13 |
| 3,260,531 | 7/1966 | Heuvel | 280/11.13 |
| 3,260,532 | 7/1966 | Heuvel | 280/11.13 |
| 3,398,968 | 8/1968 | Mutzhas | 280/602 |
| 3,531,135 | 9/1970 | Salomon | 280/11.35 |
| 3,937,481 | 2/1976 | Koleda | 280/11.35 |
| 4,221,400 | 9/1980 | Powers | 280/602 |
| 4,294,460 | 10/1981 | Kirsch | 280/617 X |
| 4,444,413 | 4/1984 | Richert et al. | 280/632 |
| 4,577,886 | 3/1986 | Chernega | 280/602 |
| 4,896,895 | 1/1990 | Bettosini | 280/618 X |
| 4,903,979 | 2/1990 | Dimier | 280/628 |
| 4,974,867 | 12/1990 | Rullier et al. | 280/607 |
| 5,135,250 | 8/1992 | Abondance et al. . | |
| 5,150,914 | 9/1992 | Gorza | 280/616 |
| 5,211,418 | 5/1993 | Scherubl | 280/602 X |

FOREIGN PATENT DOCUMENTS

| | | | |
|---|---|---|---|
| 373786 | 2/1984 | Austria | A63C 9/00 |
| 0104185 | 3/1983 | European Pat. Off. | A63C 9/00 |
| 0409749 | 7/1990 | European Pat. Off. | A63C 9/00 |
| 0424846A1 | 5/1991 | European Pat. Off. | A63C 9/00 |
| 0460574A1 | 12/1991 | European Pat. Off. | A63C 5/07 |
| 1603002 | 8/1971 | Fed. Rep. of Germany | A63C 5/06 |
| 2135450 | 7/1974 | Fed. Rep. of Germany | A63C 9/00 |
| 2833393 | 2/1980 | Fed. Rep. of Germany | 280/602 |
| 3204689 | 8/1983 | Fed. Rep. of Germany | A63C 5/07 |
| 1269049 | 6/1961 | France . | |
| 1407710 | 6/1964 | France | A63C 5/07 |
| 2433350 | 3/1980 | France | A63C 5/07 |
| 2654635 | 11/1989 | France | A63B 9/082 |
| WO/88/053-24 | 7/1988 | PCT Int'l Appl. | A63C 5/07 |

*Primary Examiner*—Mitchell J. Hill
*Assistant Examiner*—Michael Mar
*Attorney, Agent, or Firm*—D. Peter Hochberg; Mark Kusner; Michael Jaffe

[57] ABSTRACT

A system for changing the stiffness of a ski includes apparatus for variably limiting the longitudinal movement of a ski binding support plate mounted on a ski. The degree of movement determines the amount of bending possible, and thus controls ski stiffness.

8 Claims, 7 Drawing Sheets

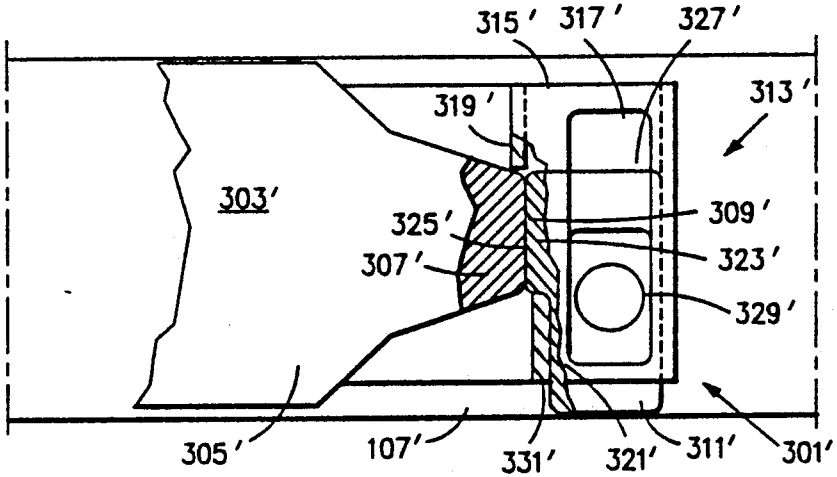
FIG. 7
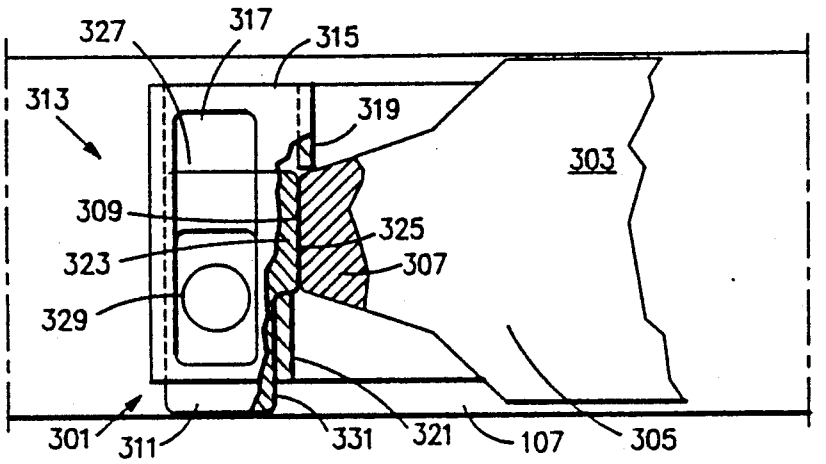
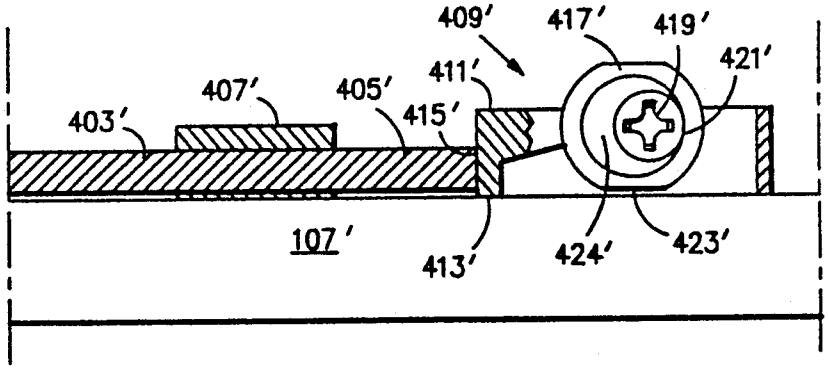
FIG. 8
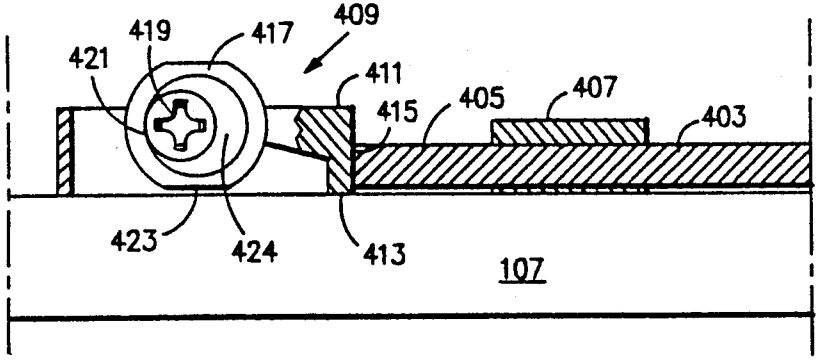

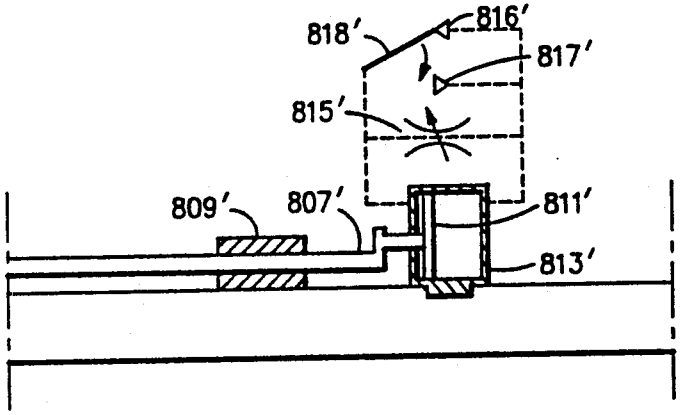
FIG.13
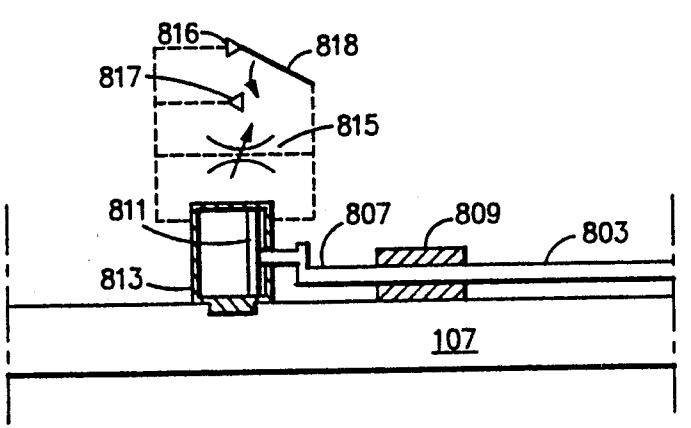
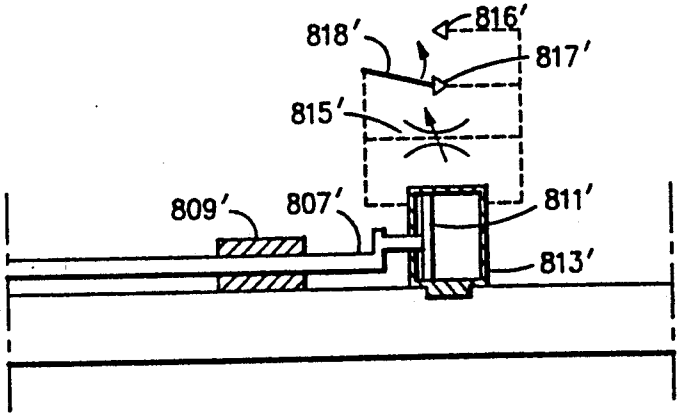
FIG.14
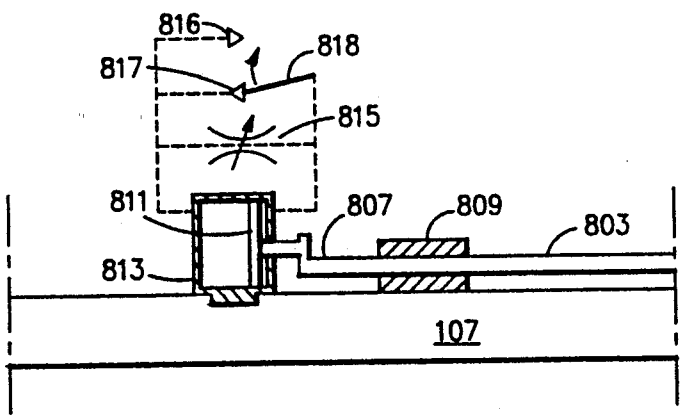

MODIFICATION OF THE FLEXIBILITY OF SKIS

This is a division of Ser. No. 900,604 filed Jun. 18, 1992 now U.S. Pat. No. 5,269,555 which is a continuation-in-part application based on U.S. patent Ser. No. 715,598, filed Jun. 14, 1991 now U.S. Pat. No. 5,251,923 for "Support Plate for a Safety Ski Binding" by Premek Stepanek, Ludwig Wagner, Edwin Lehner, Piero G. Ruffinengo and a continuation-in-part of U.S. patent application Ser. No. 828,140 filed Jan. 30, 1992, now U.S. Pat. No. 5,280,942.

BACKGROUND OF THE INVENTION

1. Field of the Invention

This invention relates to ski control apparatus for varying the characteristics of a ski according to the nature of the snow being skied upon, the type of skiing being performed, the nature of the ski and the skill of the skier, in order to improve the quality of the skiing and safety of the skier. It relates in particular to apparatus which varies the stiffness or flexibility of the ski according to the foregoing conditions.

2. Description of Background and Relevant Information

Important conditions affecting downhill skiers are the nature of the snow, the kind of skiing to be engaged in, the type of skis and bindings used and the skill of the skier. The snow and the ski run can vary during a day, while the ski and the skier are generally invariable. The snow can range from ice and hard snow, to very loose or soft snow, sometimes called powder snow. There are profound differences in skiing turns and speed, depending on the type of snow being skied upon. One characteristic of primary importance for a ski is its ability to bend or flex as it carries a skier. A ski flexes and counterflexes, and keeps the skier in control as he or she follows the contour of a slope, enabling a skier to manipulate the skis as he or she bounds and rebounds down the slope. In racing events, the snow is desirably ice hard both to increase the skier's speed and to avoid ruts in the snow. However, hard snow can limit the bending of the skis. In this regard, turning is mainly accomplished in hard snow by the skier tilting the skis to dig the edges at the bottom of the skis into the snow, accomplished by shifting his or her weight and body position. On the other hand, the skis can bend to a considerable degree in powder snow. The longitudinal sides of skis are convex arcs, and it is through the use of the side cuts dug in in the snow and the bending of the skis that the skier turns; the edges of the skis being of much less importance for turning in powder snow. Regular snow, that is snow whose texture and packing is between hard snow and powder snow, presents other problems to the skier. Experience, discussions with racers and other skiing experts, and testing, all indicate that a ski stiffer beneath the ski boot may be preferable in very hard snow conditions, while an overall more flexible ski appears to be preferable in soft snow conditions. An intermediate situation is preferable for snow of intermediate softness. It is also known that a ski loosely attached to the skier transfers less energy from the ski to the skier when the ski encounters obstacles, thus resulting in higher speed. However, a loose attachment results in loss of ski control in turns; hence it is desirable to have a loosely connected ski when traveling essentially in a straight line for greater speed, and a tightly connected ski when making turns for greater control.

The vibration characteristics of skis are also believed to be important. Skis have several vibration modes which are exhibited during skiing. High frequency vibrations break the contact between the ski-bearing surface and the snow, which improves speed. On very hard snow conditions, the breaking of the contact between a ski's running surface and snow does not result in the same level of benefit but the ski still vibrates, resulting in audible and perceptible chatter. A reduction in chatter is desirable in these conditions. Thus different requirements in underfoot stiffness and vibration exist, depending on snow conditions. The ski designer, faced with the different kinds of snow, the different types of skiing, and variations in skiers and their bindings, can only develop skis which can handle all of these varying characteristics reasonably well, but which are not optimized for any specific condition.

All ski bindings have an effect on ski stiffness underfoot. When a ski bends during skiing, the distance between the toe piece and the heel piece changes since they move relative to each other with the upward curvature of the ski. However, the length of the ski boot sole remains constant. Therefore, there is generally a limited movement rearwardly of the heelpiece in a clamp on the ski to keep it in contact with the boot. The force required to move the heel unit back results in a stiffening of the ski section directly under the binding and boot. It is believed that most ski bindings on the market fall into this category. Therefore, ski manufacturers take this stiffening action of the binding system into consideration in the design of the ski. The underfoot stiffness of the ski/binding combination is thus optimized for the type of skier and preferred snow conditions the ski was designed for. Different binding systems and separate devices to be used in conjunction with the ski and commercially available bindings have been manufactured to either increase or decrease the underfoot stiffness of the basic binding/ski configuration. Other devices can also affect the normal vibration of a ski. Combinations which decrease stiffness underfoot may improve soft snow skiability, while deteriorating skiability towards the end of the hard snow spectrum. Combinations which increase stiffness have the opposite effect.

In some systems, the binding is constructed to render the ski more flexible. In the ESS v.a.r. device, for example, a boot support plate having a forward portion which is slidable in a channel on the ski, should render the ski more flexible. However, the support plate is fixed with additional fastening means to the ski, and thus is believed to limit its benefit on soft snow. The fixing of the support plate decreases the bending of the ski.

The Tyrolia Freeflex system utilizes a flexible plate attached to the top of the ski. The plate is fixed to the ski at the toe of the binding, and is held in place about the heel by a slidable clamp fixed on the ski. Both toe and heel binding units are affixed on the boot support plate. When the ski bends, the heel clamp moves closer to the toe unit but the flexible plate is allowed to slide rearwardly, reducing the tendency of the heel unit to move towards the toe unit as in a normal binding configuration. The ski is thus allowed to flex more underfoot. The plate is able to move in the slidable clamp but is also held to the ski by an additional sliding point between the toe and the heel. This mounting configuration increases sliding friction and thus the overall decrease of ski stiffening is relatively small. Devices of this nature are disclosed in U.S. Pat. No. 3,937,481.

Most ski binding manufacturers produce bindings which increase the stiffness of skis. The stiffness of a ski provides a firm edge to drive into the snow for making turns in hard or intermediate snow. In this respect, it is much like an ice skater who drives his or her blade into the ice to make a turn. A flexible blade would detract from the skater making a turn, just as a very soft ski in the section directly below the boot would detract from the skier turning in hard snow.

Some expert skiers performing giant slalom or super giant slalom have found that their turning ability is enhanced when they attach to the ski, for example, by gluing, a thin plate on top of the ski in the binding area. This added plate increases the distance between the skier's boot and the edges of the ski, and enhances the leverage which the skier has to drive the edges of the ski into the snow. WIPO Document 83/00039 discloses a device wherein glue and an elastomeric material hold a plate for supporting a toe piece and heel piece to the ski. The elastomeric material absorbs some of the vibration of the ski on the hard snow and relieves some of the discomforting noise of the ski smacking rapidly against the snow. Furthermore, the device stiffens the ski/-plate/binding combination in the underfoot area of the ski, improving edge control on hard snow. In another device called the Rossi-Bar, disclosed in European Patent Office Publication No. 0409749, a support bar on the ski has stops of elastomeric material at its forward and rearward ends. The bar is locked to the ski by clamps along the length of the bar. This device stiffens the ski underfoot and stiffens the ski's vibration, but its effect on the ski flex is not adjustable by the skier. In U.S. Pat. No. 3,937,481 mentioned earlier, a ski binding having an elongated plate is slidably mounted thereon for cushioning the skier when a forward abutment is encountered. Only the forward or toe portion of the system is fixed to the ski, so that the plate allegedly follows the bending of the ski. The device in fact impedes the bending of the ski since it is strapped to the ski in a number of places. A similar device with similar shortcomings is disclosed in Austrian Patent 373,786. A device of this type is sold under the name Derbyflex. It has been believed by many experts that raising the ski binding with such a plate detracts from the skier's ability to control the ski, since it has been thought that the skier has to be close to the snow to "feel" the snow and ski accordingly. The present inventors and other manufacturers believe that this notion is wrong for most types of skiers, and that holding a ski boot somewhat higher over the ski increases his or her ability to control the ski. Other patents disclosing ski bindings for increasing stiffness in skis include German Patent 2,135,450 and European Publication 0409749A1.

Even though the added plate is beneficial, it only applies to skiing on hard snow where a stiffer underfoot ski is desirable. When used on softer or powder snow, the added stiffness detracts from the skier's ability to control the ski since easier bending adds to the turnability of the ski in soft snow.

In European Patent Publication No. 0460574, various embodiments for changing the flexibility and dampening of a ski are disclosed. The disclosed publication is limited to the portions of the ski which are forward or rearward of a ski binding. In one embodiment, an elongated covering element is located between forward and rearward seating portions in which springs or resilient blocks are located, and the ends of the covering element engage those springs or blocks. The length of the covering element can be varied to vary the flexibility and/or vibration dampening of the ski.

U.S. Pat. No. 2,258,046 discloses another device for varying the flexibility of a ski which does not involve a ski binding. In this device, a leaf spring mounted on the ski slides as the ski is bent. A clamp fixed to the ski carries the ski boot over the spring. In one embodiment, a cam selectively depresses the spring to allegedly stiffen the ski.

Other devices are known having movable boot support plates on skis. For example, U.S. Pat. No. 4,974,867 discloses a shock absorbing buffer disposed between a ski and a binding, and is not really related to the stiffness of the binding.

The skill of the skier is another condition which skiing apparatus should take into consideration. Although stiff skis could be beneficial to good skiers in events such as giant slalom and super giant slalom, novice skiers generally use flexible skis for all events, since they enable reasonable performance even though edge control in turns may be sacrificed.

The inventors are unaware of any ski bindings which are adaptable to vary the stiffness in the binding location of a ski system according to the nature of the snow or the type of skiing being done. They are aware of no skiing system whose stiffness and vibration characteristics can be changed to perform well in the various skiing conditions.

BRIEF DESCRIPTION OF THE INVENTION

It is an object of the invention to provide an improved device for controlling snow skis according to the nature of the snow, the skiing to be done, the type of skis and/or the skill of the skier.

Another aspect of the invention is to provide a support plate for a ski binding which controls the stiffness of skis in different skiing conditions.

A further object of the invention is to provide a device for controlling the stiffness of skis incorporating a plate fixable to a ski and having slidable portions, and impedance means for controlling the slidable device to obtain the desired stiffness.

Another object of the invention is to provide apparatus for controlling the stiffness of a ski with the apparatus having an engagement device movable in forward and rearward directions as the ski bends, an attachment device for attaching the engagement member to a ski, an impedance device having at least two impedance members such as resilient members selectively engageable by the engagement device to modify and change the modification of the flexibility for the ski, and a selection device for selecting the resilient members.

It is yet another object of the invention to provide skier-selectable dampening means for a ski, to improve a skier's control during the vibration of the ski.

It is yet another aspect of the present invention to provide an apparatus for controlling the stiffness of the ski, and for adding shock absorption to the binding.

It is a general object of the present invention to provide an improved ski control system for use with various types of snow, different degrees of skill of the skier and different skiing events, which system is efficient to manufacture and to use.

Other objects will become clear from the description to follow and from the appended claims.

According to an embodiment of the invention, engagement means such as a boot support plate of a binding includes active surfaces, such as forward and rearward portions which can be moved longitudinally relative to the ski as the ski bends. Resilient members are attached to either the active surfaces of the engagement means, or to selection means which are in the path of the engagement means as the ski bends. The selection means can be optionally set to determine which if any of the resilient members are engaged as the ski bends, to modify and change the modification of the flexibility of the ski.

BRIEF DESCRIPTION OF THE DRAWINGS

The invention will be better understood when reference is had to the following drawings in which like-numbers refer to like-parts, and in which:

FIG. 7 is a schematic drawing of another form of the stiffness system for a ski where the adjustable stops are transversely movable members;

FIG. 8 is a schematic drawing of still another form of the stiffness system where the adjustable stops include eccentric cylinders on rotatable horizontal axes transverse to the ski;

FIGS. 13 and 14 are schematic drawings of a ski stiffness system where hydraulic systems comprises the impedance means;

DETAILED DESCRIPTION OF THE PREFERRED EMBODIMENTS OF THE INVENTION

Figures 1, 1A, 2, 3:
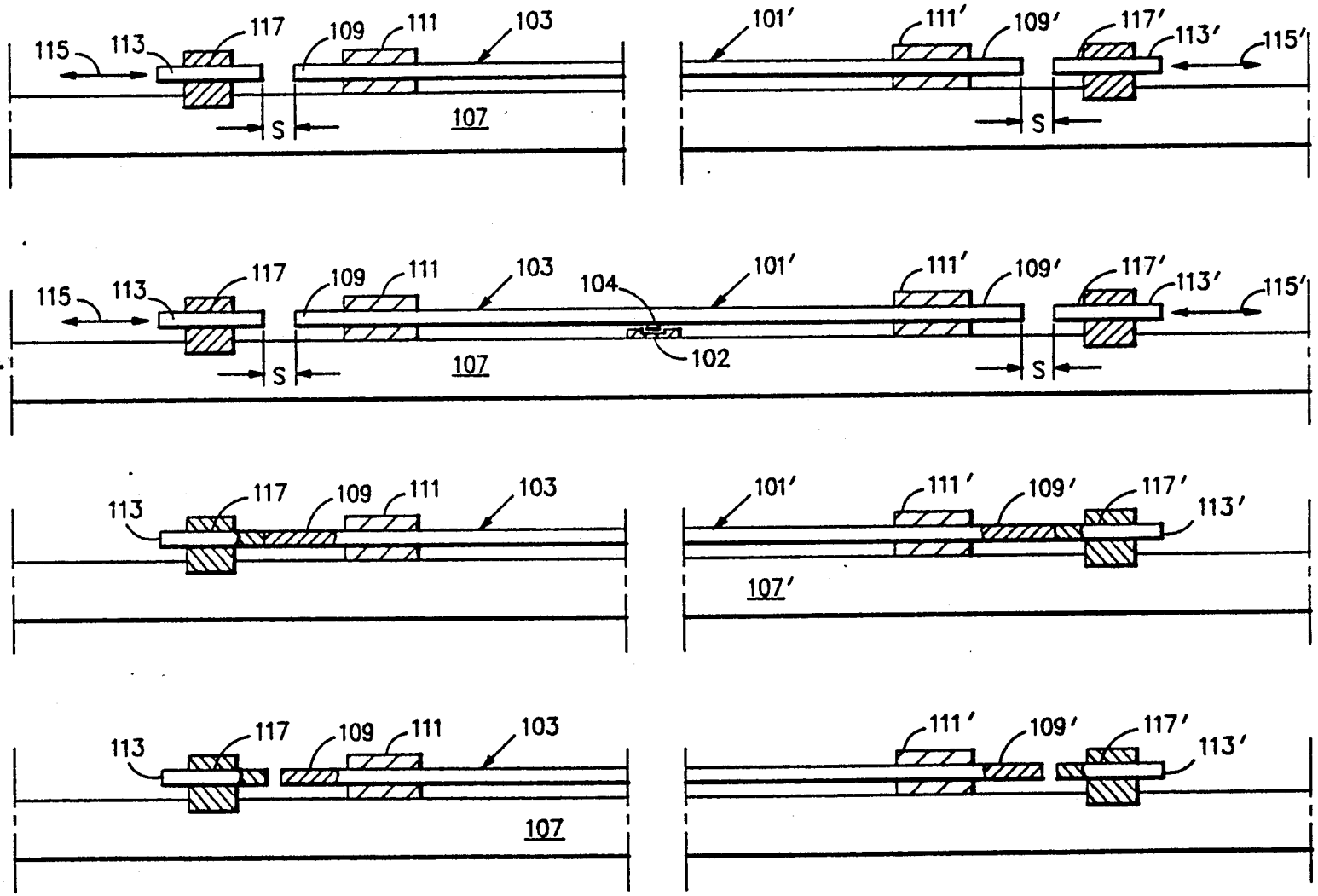
FIG. 1 is a schematic drawing showing an engagement means as a support plate, and impedance means as adjustable stops.
FIG. 1A is a schematic drawing showing an engagement means as an anchored support plate, and impedance means as adjustable stops.
FIGS. 2 and 3 show two settings of the apparatus shown in FIG. 1.

A stiffness controlling assembly 101 is shown in FIG. 1. The assembly includes an engagement means which can be a support plate 103, having active surfaces such as ends 109 and 109'. Ends 109 and 109' are free ends which can slide in a longitudinal direction of ski 107 within guide means such as support clamps 111 and 111'. (As used herein, the active surfaces of an engagement means refers to the forward and rearward facing portions of, for example, the support plate 103, which face forwardly or rearwardly, and whose distance to a forward or rearward part of a ski can vary as the ski bends. It is preferable that the active surfaces are at the ends of the engagement means, since this is where the most extensive movement between the ski and the engagement means occurs when the ski bends. In some cases the active surfaces can operate independently with the corresponding parts of the impedance means.) Impedance means, shown here as adjustable members, control members, or stops 113 and 113', can be moved forwards or rearwards to preselected positions as indicated by the arrows 115 and 115' within their holding members, bases or clamps 117 and 117' respectively. As shown, adjustable stops 113 and 113' can be moved relative to plate 103 and ski 107, within clamps 117 and 117' as indicated by arrows 115 and 115'.

With respect to FIG. 1A, an anchoring assembly is provided comprising, for example, a retainer bracket 102 fixed to ski 107. An associated pin 104 is attached to support plate 103, the engagement of the pin in the bracket permitting the ends of the support plate 103 to move longitudinally relative to the ski 107 as the ski flexes, but preventing uncontrolled longitudinal movement of the support plate, with the length of pin being such as to assure its engagement with the bracket 102 even when the ski is fully flexed. When thus anchored the support plate 103 is unable to slide either backward or forward when S is greater than 0.

The bracket 102 is positionable at various places along the support plate 103, for example, in its middle, or more preferably at the lowest deflection point of the ski. When positioned, the engagement of the pin 104 with the bracket 102 keeps the center of plate 103 stationary with respect to the center of the ski during flexing and counterflexing without interferring with the free flexing action when S is greater than 0.

Furthermore, the addition of the anchoring assembly permits S either at the front or rear ends of the support plate 103 to be adjustable to different settings, thus allowing any combination of stiffness for the front and the rear of the ski, a distinct advantage.

Figure 4:
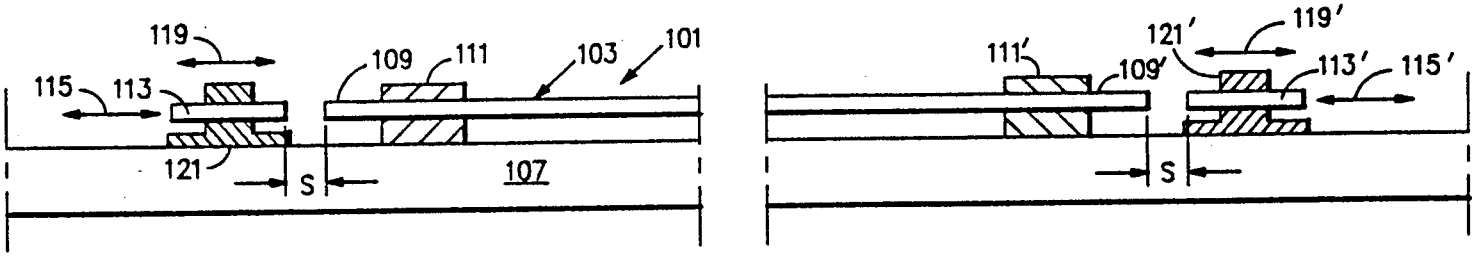
FIG. 4 is a schematic drawing of the apparatus of FIG. 1, but with adjustable clamps.

Referring to FIG. 4, movable clamps 121 and 121' can also be moved with stops 113 and 113' held therein for preliminary adjustments, such as by a store or ski shop, to set the stiffness controlling assembly for the type of ski and skill of the skier, as indicated by arrows 119 and 119'. A space of variable distance between stop 113 and end 109 and between stop 113' and end 109' are designated by the letter S.

When assembly 101 is to reduce the bending of the ski, as for example when the ski is to be turned in hard snow, adjustable stops 113 and 113' are moved to engage free ends 109 and 109' of support plate 103, so that S equals 0, as shown in FIG. 2. This renders plate 103 substantially unable to move as bending moments are applied to the ski, and makes the ski stiff beneath plate 103. When the ski is to have its bending unimpaired, stops 113 and 113' are moved away from plate 103 as shown in FIG. 1, so that S has a relatively high value. Then, regardless of the bending of the ski 107, plate 103 cannot engage stops 113 and 113', and no additional stiffness is added to the ski. For an intermediate stiffening condition, as where the skier is making turns on regular snow, S is set to a moderate value as shown in FIG. 3, so that free ends 109 and 109' only contacts stops 113 and 113' during turns when the ski bends sufficiently for the contact to occur, to avoid further bending and improve edge control. The assembly could be arranged so that stops 113 and 113' are always set for intermediate stiffness control as shown in FIG. 3, in which holder 117 and 117' would not allow the adjustment of stops 113 and 113'.

It should be noted at this time that the foregoing and many of the drawings to follow are schematic in nature, and that S need not be a complete space but could be filled with some resilient substance therein; however, the stiffening feature of the invention will nonetheless apply. Also, the support plate 103 has been shown as an integral member, but it could include a number of members whose effect is as shown for stiffening the ski. Likewise, the adjustable members or stops can have different forms, some of which are shown below.

Figure 5:
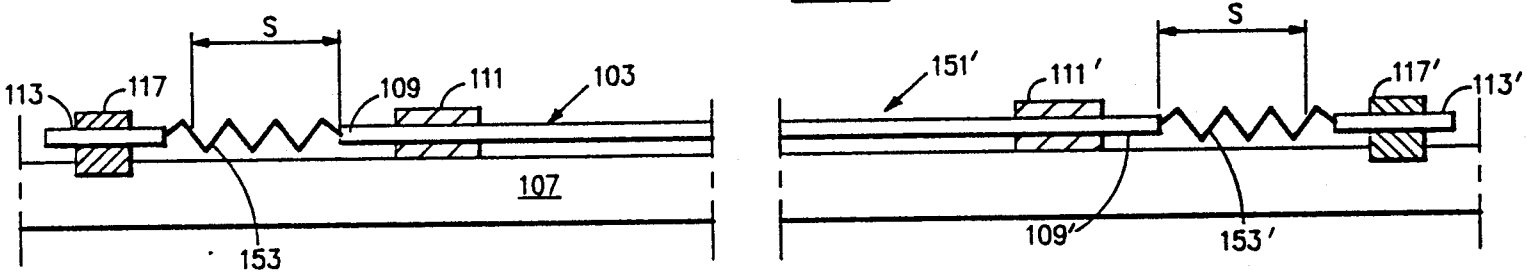
FIG. 5 is a schematic drawing showing where the impedance means includes progressively variable members as the ski flexes and counterflexes.

Another form is illustrated schematically in FIG. 5, showing an embodiment where a mechanical spring or some type of spring-like material is included in space S. As in the previous Figures, the assembly 151 of FIG. 5 includes a plate 103 whose free ends 109 and 109' are supported for sliding movement in support clamps 111 and 111'. Adjustable stops 113 and 113' are held by clamps 117 and 117'. Biasing means such as coil springs 153 and 153' are connected between the ends of free ends 109 and 109' and the ends of stops 113 and 113' facing them. As free ends 109 and 109' move towards stops 113 and 113' when ski 107 bends, springs 153 and 153' compress. As springs 153 and 153' compress even more with increased bending, the spring forces get progressively greater, resisting the sliding of free ends 109 and 109'. This impedes further bending of the ski. As ski 107 continues to bend, the spring eventually become totally compressed, S declines to the length of the fully compressed spring (S being the distance between the ends of free ends 109 and 109' and the ends of the totally compressed spring 153 and 153'). At this point, plate 103 is unable to slide towards stops 113 and 113' and the ski beneath plate 103 is stiffened considerably. In this configuration, when the skier unweights the ski 107, for example, during the time period between successive turns, the energy stored in springs 153 and 153' during the compression or flexing period is released to the ski through stops 113 and 113', causing the ski to counterflex and thus unweigh more rapidly and effortlessly. This improved counterflex action reduces skier fatigue and improves skiing.

Figure 6:
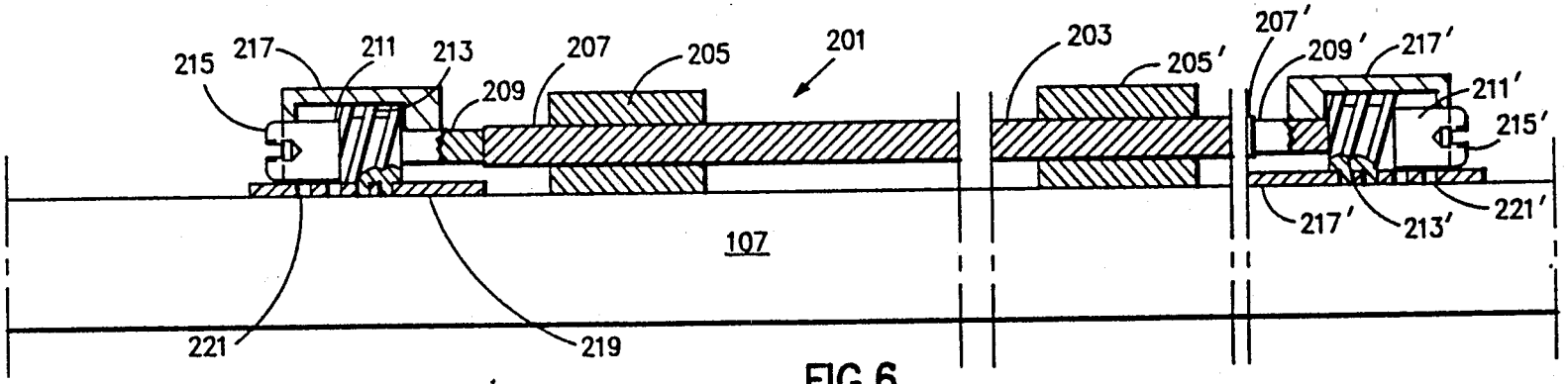
FIG. 6 is a schematic drawing of a stiffness system having screw adjustable stops.

A schematic of another embodiment 201 is shown in FIG. 6. Here, a support plate 203 is mounted above a ski 107, with ends which are free-clamped for sliding engagement over the ski by clamps or guides 205 and 205'. Free ends 207 and 207' are mounted for engagement with control members or adjustable stops 209 and 209' which are urged forwardly or backwardly by screws 211 and 211' having threads 213 and 213' and heads 215 and 215'. Screws 211 and 211' are mounted in housings 217 and 217'. A base plate 219 having thread receiving slots 221 and 221' are mounted beneath housing 217 and 217' on ski 107. With adjustable stops 209 and 209' in engagement with free ends 207 and 207' of the support plate, the support plate 203 is in a stiffening configuration, and restricts the ski from bending beneath assembly 201. In this implementation, the space S, not shown, between free ends 207 and 207' and adjustable stops 209 and 209' can be adjusted simply by turning screws 211 and 211'. With S=0 the ski is relatively stiff underneath assembly 201. If S is very large, assembly 201 has essentially no effect on the stiffness of the ski under the assembly. The skier can also adjust S for different relatively small values to stiffen the ski more or less during turns.

FIG. 7 shows a transversely movable assemblies 301 and 301' as part of another embodiment. Here, a partial top view of the ski 107 includes a support plate 303 which is free at its ends 305 and 305'. Ends 305 and 305' have narrow portions 307 and 307' which terminate in forwardly facing abutments 309 and 309'. Transversely movable assemblies 301 and 301' comprise transversely movable control members 311 and 311', housings 313 and 313' including top walls 315 and 315', bases 317 and 317', walls 319, 319' 321, 321' and apertures 327 and 327'. Members 311 and 311' are mounted for movement transverse to ski 107. Control member 311 has rearwardly facing protuberance 323 with rearward abutment face 325. Likewise, control member 311' has forwardly facing protuberance 323' and forward abutment face 325'. Members 311 and 311' have pegs or handles 329 and 329' extending through apertures 327 and 327', respectively. Surfaces are provided defining recesses 331 and 331' which extend partly transverse to the ski and are adjacent protuberances 323 and 323'. Members 311 and 311' can be moved across the ski by sliding pegs 329 and 329' along apertures 327 and 327'. Top walls 315 and 315' retain members 311 and 311' in place. Support walls 321, 321', 319 and 319' extending transverse to the ski are provided for maintaining members 311 and 311' in place when members 311 and 311' are in either of their positions, i.e., on the upper part of FIG. 7 when recesses 331 and 331' face abutments 309 and 309', or when (as shown) abutments 325 and 325' oppose abutments 309 and 309'. When the ski is to be placed in its extremely stiff mode, such as when the skier is going to perform giant slalom or superior giant slalom events in hard snow, the skier moves slides 311 and 311' so that the slide abutment faces 325 and 325' engage abutments 309 and 309' as shown in FIG. 7. As the ski attempts to bend or flex, support plate 303 is held fast by members 311 and 311', giving the ski its stiff underfoot quality, providing the skier with more control during turns on the ski run. On the other hand, when the ski is to be used in softer snow, slides 311 and 311' are moved upward so that recesses 331 and 331' face abutment surfaces 309 and 309'. In this setting end 305 of plate 303 is free to move forward and end 305' of plate 303 is free to move rearwardly when the ski flexes and the ski is not stiffened. This embodiment, shown with two positions could be implemented with additional positions and intermediate recesses for obtaining intermediate stiffening conditions.

Still another embodiment is shown in FIG. 8. Here, a support plate 403 has free ends 405 and 405'. Clamps or guides 407 and 407' hold plate 403 for sliding engagement relative to ski 107. Retaining member 409 has a rearwardly extending control arm 411 having a downwardly extending foot 413 whose rearwardly facing face 415 is an abutment or contact. Similarly, retaining member 409' has a forwardly extending control arm 411' with a downwardly extending foot 413', and a forwardly facing face 415' for abutment with plate 303. The retaining members 409 and 409' include horizontal cylinders 417 and 417' having axes perpendicular to the longitudinal axis of the ski. Axes of rotation 419 and 419' are offset from the natural rotational axis. Cylinders 417 and 417' are rotatable about axes 419 and 419', forward and rearward, respectively, of the center of rotation of the foregoing cylinders by means of a tool such as a screw driver inserted into the heads 421 and 421'. Rotation of heads 421 and 421' counterclockwise and clockwise, respectively, rotates eccentrics 424 and 424' counterclockwise and clockwise, respectively, moving the arms 411 and 411' away from the supporting plate 403. Sufficient movement of arms 411 and 411' provides a space between abutments 415 and 415' and the free ends 405 and 405' of support plate 403, providing a space between the two members so that support plate 403 allows limited bending of ski 107. The further arms 411 and 411' are from support plate 403, the more bending is possible.

Figure 9:
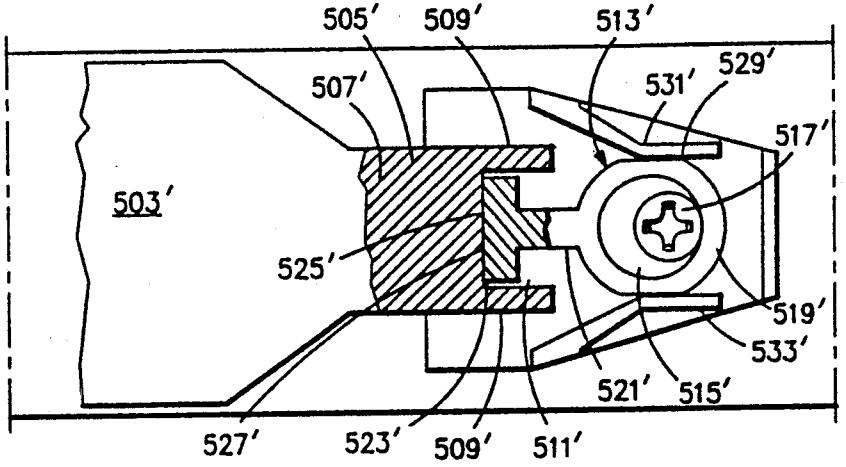
FIG. 9 is a schematic drawing of a form of a stiffness system where adjustable stops include eccentric members rotatable about axes vertical to the ski.

Referring next to FIG. 9, the device somewhat similar to that shown in FIG. 8 is illustrated. Here, a support plate 503 includes free ends 505 and 505' which are tapered toward their longitudinal axis to form a forwardly extending legs 507 and 507', respectively. Legs 509 extend on opposite sides of centrally located recess 511, and legs 509' extend on opposite sides of recess 511'. Adjacent the free ends of the support plate are disposed eccentric adjustment or control members 513 and 513' having cylindrical members 515 and 515' and turning heads 517 and 517'. Eccentrics 513 and 513' rotate about the central axis of cylinders 515 and 515' as heads 517 and 517' are rotated. Adjustment members or stops 513 and 513' include followers 519 and 519' defining a cylindrical bore in which cylindrical members 515 and 515' are concentrically located, and rearwardly extending legs 521 and 521', terminating in transverse legs 523 and 523'. Leg 523 has rearwardly extending abutment face 525, and leg 523' has forwardly extending abutment leg 525'. The latter abutment faces face abutment faces 527 and 527', respectively, of support plate 503. The followers have flat surfaces 529 and 529' on opposite sides thereof for engagement with opposite, external surfaces 531 and 531' of springs 533 and 533' extending from a base plate.

The stiffness of the apparatus shown in FIG. 9 depends upon the location of adjustment faces 525 and 525' and the abutment faces 527 and 527' of support plate 503. In their innermost positions, the adjustment members engage faces 527 and 527' of support plate 503, so that the support plate cannot move relative to the ski, to render the ski stiff. If the eccentrics are turned counterclockwise and clockwise, respectively, the followers move outwardly and create spaces with forward parts 509 and 509' of the support plate 503. If the spaces are sufficient so that no amount of bending will cause surfaces 525 and 525' to engage the support plate 503, considerable bending of the ski is possible, and would be particularly useful in powder snow. On the other hand, where the ski is to become stiff only in conditions of hard curves, the eccentrics are moved to create spaces between abutment surfaces 525, 525', 527 and 527'. When there is not sufficient bending of the ski, as in straight skiing down a slope, the support plate allows the ski to bend. However, if there are hard turns made, the abutment surfaces 525 and 525' engage the forwardly facing abutment surfaces 527 and 527', rendering the ski stiffer and less flexible. The rotation of the eccentrics thus determine the spacing between the two abutment surfaces and the relative stiffness of the ski.

Figure 10:
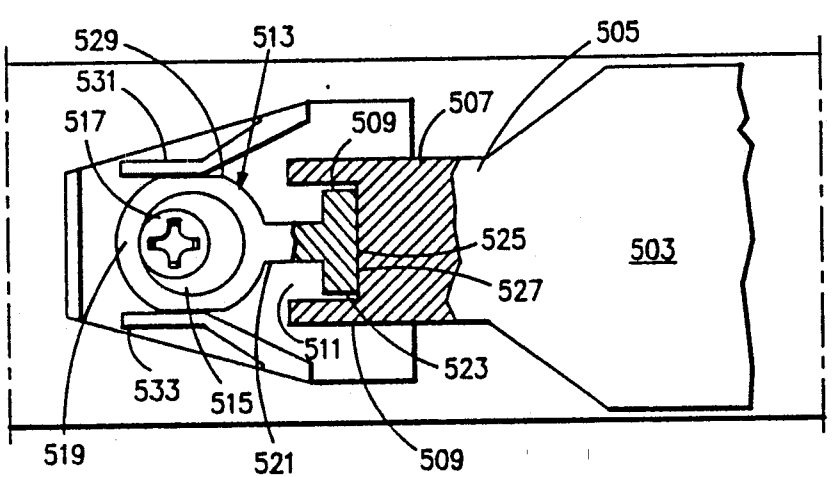
FIG. 10 is a schematic drawing of a form of a stiffness system where the impedance means are continuously variable bias devices which include friction members.
Figure 10:
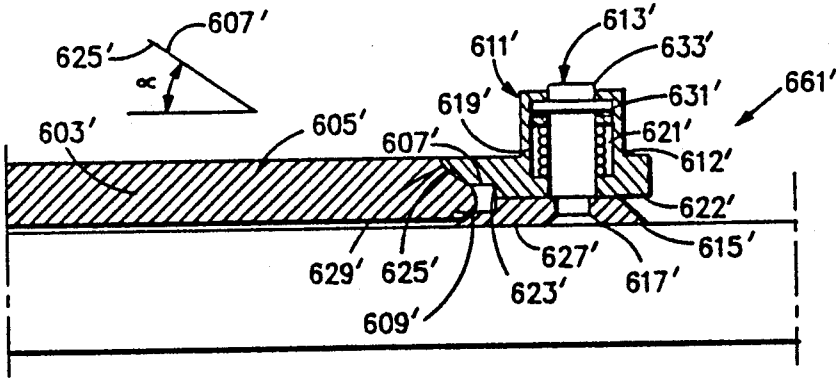
Figure 10:
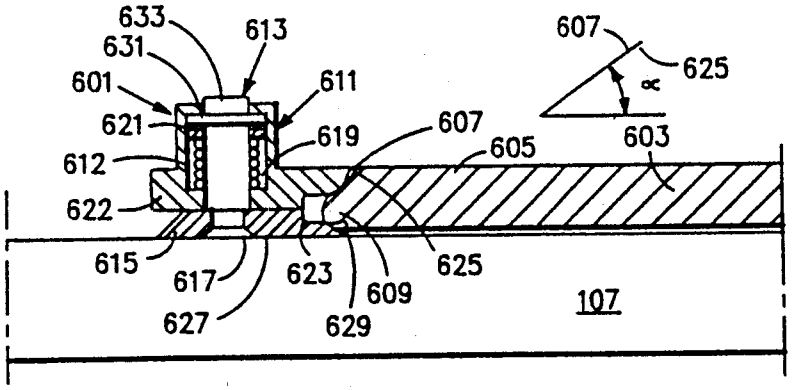

Referring next to FIG. 10, stiffness controlling assemblies 601 and 601' are shown including a support plate 603 having two free ends 605 and 605'. The free ends have tapered portions at the upper and lower part of plate 603 with inclined faces shown at 607 and 607', 609 and 609', which run transverse to ski 107. Adjustment, control or retainer members 611 and 611' have housings 612 and 612' which are attached to the ski by means of a fastener such as screws 613 and 613' and holding members 615 and 615', which are attached to the ski, for receiving retainer or fastening members 613 and 613' through bores 617 and 617' contoured to receive the fasteners. Springs such as helical springs 619 and 619' are disposed in housings 612 and 612' and are located to be compressed by compression members such as nuts 621 and 621' as fasteners 613 and 613' are rotated. Springs 619 and 619' are compressible between shoulders 622 and 622' in housings 612 and 612' and members 621 and 621'.

Retainer members 611 and 611' include flanges 623 and 623' which extend inwardly, and have inclined abutment faces 625 and 625' which are contoured to engage the faces 607 and 607' of plate 603. Holding members 615 and 615' also have flanges 627 and 628' extending partly along the length of ski 107, and having an inclined portion with faces 629 and 629' contoured to engage the faces 609 and 609' of plate 603.

Screws 613 and 613' have flanges 631 and 631' which are seated beneath the upper end walls of housings 612 and 612' of adjustment members 611 and 611', and have heads 633 and 633' which can be turned to either move nuts 621 and 621' into holding members 615 and 615' to compress springs 619 and 619', or to be urged in the opposite direction to relieve the compression on springs 619 and 619'.

The stiffening in the apparatus shown in FIG. 10 is accomplished by friction rather than by spacing between an adjusting member and a support plate. The apparatus is continuously adjustable.

Therefore, in the operation of assemblies 601 and 601' in FIG. 10, if further stiffening of the ski is desired, screws 613 and 613' are tightened to move nuts 621 and 621' towards the ski to compress springs 619 and 619'. This compression urges adjusting members 611 and 611', and the faces of legs 623 and 623' against faces 625 and 625' of plate 603. The tension created by faces 607 and 607', faces 625 and 625', faces 609 and 609' and faces 629 and 629', essentially clamps plate 603 to the ski at its ends 605 and 605', to substantially prevent bending of ski 107 between fasteners 611 and 611'. In its most compressed condition, the ski apparatus is extremely stiff underfoot, and is particularly useful in curves made on hard snow. As fasteners 613 and 613' are loosened, the compression on springs 619 and 619' decreases, and the tension on ends 605 and 605' of support plate 603 becomes less and less. In its least compressed condition, the portion of ski 107 under support plate 603 is essentially bendable, and is particularly useful for skiing on loose or powder snow. There is no need for a clamp to guide support plate 603 along ski 107 as the ski bends, since the forward end of the plate is confined between retainers 611 and 611' and holding members 615 and 615'. The friction device 601 has some useful features. First, the springs are a progressive force, the spring forces increasing as the support plate between the retainers 611 and 611' and the holding members 615 and 615', increasing stiffness as the ski bends. Second, the springs provide greater friction for flexing than for counterflexing. The friction approaches 0 as the angle $\alpha$ approaches 0.

Figure 11:
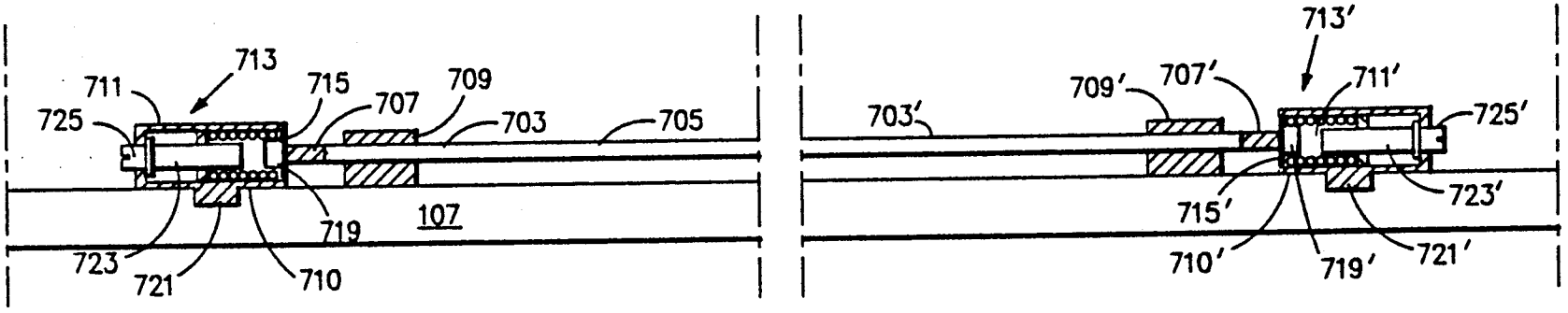
FIG. 11 is a schematic drawing of a form of a ski stiffness system where the impedance means are continuously variable devices.

Another continuously adjustable stiffening system is shown in FIG. 11. Here, a support plate 703 is attached to the ski 107 by clamps 709 and 709' through which the ends 707 and 707' can slide as the ski bends. Springs 710 and 710' are disposed in housings 711 and 711' of retainers 713 and 713'. Housings 711 and 711' are fixed to ski 107. Housing 711 has a rearward face 715, and housing 711' has a forward face 715'. Faces 715, 715' have bores through which parts 707 and 707' of plate 703 extend respectively. Enlarged portions 719 and 719' are part of ends 707 and 707', and are larger than the bore in faces 715 and 715' to preclude ends 707, 707' from being removed from housings 711 and 711'. Springs 710 and 710' rest against portions 719 and 719' and extend to shoulders 721 and 721' through which control fasteners 723 and 723' extend. Fasteners 723 and 723' extend through housings 711 and 711' along a longitudinal axis above ski 107, opposite plate 703.

In order to change the stiffness of the skiing apparatus shown in FIG. 11, fasteners 723 and 723' can be moved to change the compression of springs 710 and 710', such as by turning their screwheads 725 and 725' with a screwdriver. At its extreme stiffness, fasteners 723 and 723' are moved to completely compress springs 710 and 710'. As the fasteners are turned to release springs 710 and 710', the stiffness of the skiing apparatus beneath plate 703 decreases. Thus, if the snow is harder, the fasteners 723 and 723' can be adjusted to compress springs 710 and 710' to make the ski stiffer in the portion directly under the apparatus. As the snow gets softer, springs 710 and 710' should be decompressed to enable the control of the ski as discussed earlier.

Figure 12:
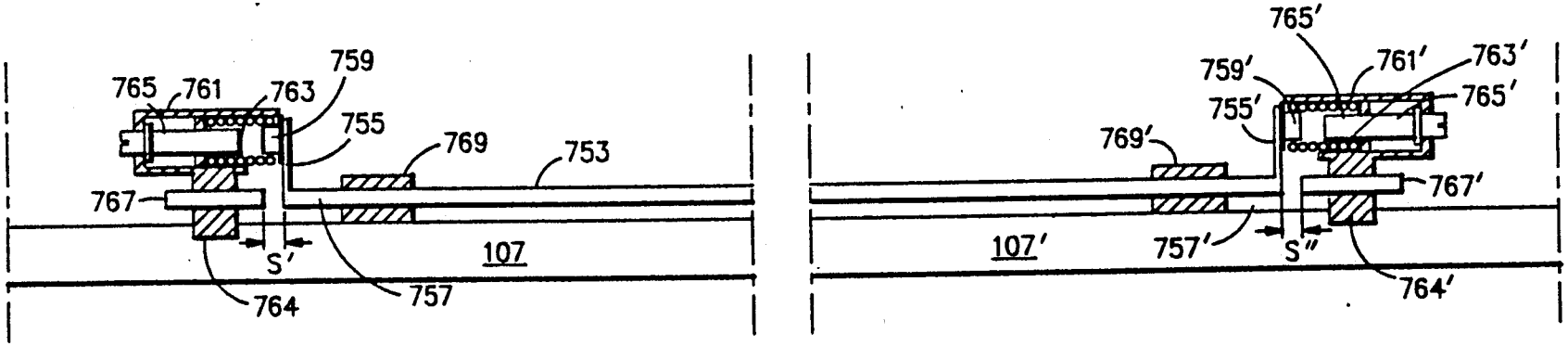
FIG. 12 is a schematic drawing of a form of a ski stiffness system where the impedance means includes two components, each having both a discrete stop device and a continuously variable device.

A modification of the embodiment shown in FIG. 11 is shown in FIG. 12. Here, a support plate 753 is attached to ski 107 as described above with respect to FIG. 11, and has flange 755 attached to forward end 757 and flange 755' attached to rearward end 757' of support plate 753, with block 759 and 759' respectively. Housings 761 and 761' hold springs 763 and 763' and control fasteners 765 and 765', and these all function as corresponding members did in the preceding Figure. Housings 761 and 761' rest on supports 764 and 764' which are fixed to ski 107. Stops 767 and 767' extend through supports 764 and 764', opposite plate 753. A space S' exists between the rearward end of stops 767 and 767' and ends 757 and 757' of plate 753. The stiffness of the ski is continuously adjustable by means of fasteners 765 and 765' and the compression of springs 763 and 763'. In addition, the ski also becomes stiff during curves when ends 757 and 757' of plate 753 contact stops 767 and 767'. Stops 767 and 767' could be adjustable, and could be moved away from plate 753 so that these members do not contact each other at all, or less frequently, as for example in powder snow. Stops 767 and 767' can thus be spaced from plate 753 by an intermediate amount so that ends 757 and 757' and stops 767 and 767' only contact each other during curves as described previously. Stops 767 and 767' could also be adjusted to contact ends 757 and 757' to allow the skier to stiffen the ski under the assembly to a maximal value. Ends 757 and 757' slide relative to ski 107 through clamps 769 and 769'.

Hydraulic embodiments are shown in FIGS. 13 and 14. In these Figures, support plate 803 is fixed at its opposite end portions to the ski by clamps 809 and 809' attached to ski 107 through which free ends 807 and 807' are slidable as the ski bends longitudinally. The free ends 807 and 807' of plate 803 are attached to pistons 811 and 811' slidable in fluid cylinders 813 and 813', which are part of a hydraulic circuit. Cylinders 813 and 813' are fixed to ski 107. The part of the cylinder chambers outward of pistons 811 and 811' are connected by fluid lines to adjustable valves 815 and 815', selected ones of oppositely directed, uni-directional valve heads 816, 817 and 816', 817'; and manual fluid valve selectors 818 and 818' connected to fluid lines for the fluid in cylinders 813 and 813' on one chamber or side of pistons 811 and 811'. When the system is set up as shown in FIG. 13, as the ski bends or flexes, ends 807 and 807' and pistons 811 and 811' move rapidly outwardly through the chamber in cylinders 813 and 813', respectively, since fluid is forced from the cylinders through fast flowing, one way or uni-directional valve heads 816 and 816', through valve selectors 818 and 818' and into the side of the cylinder chambers behind pistons 811 and 811'. In this configuration the ski can flex downwardly freely and easily since pistons 811 and 811' encounter little resistance in their forward and rearward movements, respectively. When the downward loads which caused the ski to flex are reduced-such as the end of a turn-the ski will tend to return to its normal flex state as fluid flows from the inward side of cylinders 813 and 813', through adjustable valves 815 and 815' and into the cylinders on the outward side of pistons 811 and 811'. The rate of counterflexing will be determined by the adjustment of adjustable valves 815 and 815'. The counterflex speed of the ski can thus be adjusted by the setting of valves 815 and 815', and the counterflex can be dampened.

In FIG. 14, valve selectors 818 and 818' are operatively connected to uni-directional valve head 817 and 817'. Now when the ski flexes, free ends 807 and 807' force pistons 811 and 811' outwardly and fluid flows through adjustable valves 815 and 815'; this is generally a slow flow rate depending on how valves 815 and 815' are adjusted. During counterflex, the fluid moves very quickly from the inward side of pistons 811 and 811', through one way valves 817 and 817' so that the pistons return quickly to the embodiment shown in FIG. 14. This is good for the free and easy counterflexing movement of the ski.

Figure 15:
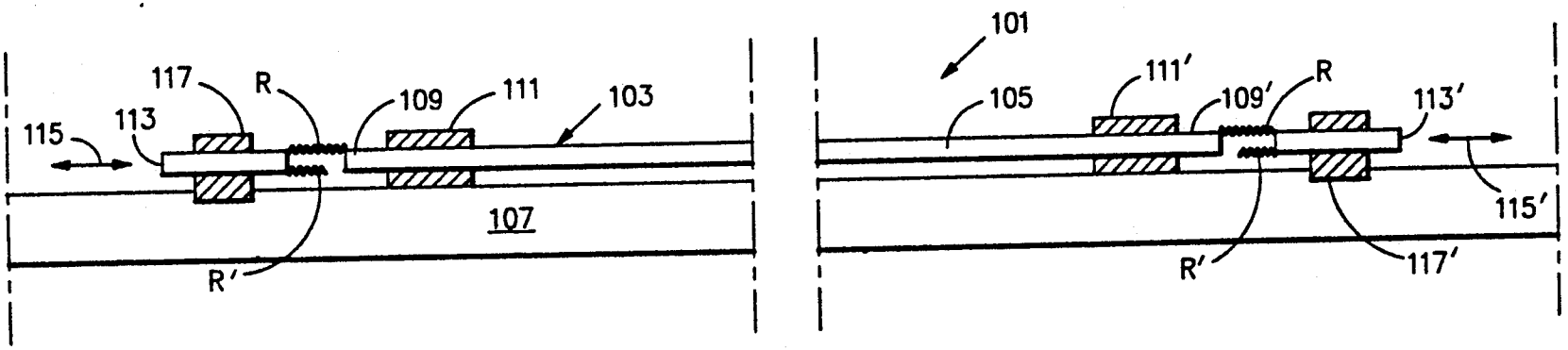
FIG. 15 is a schematic drawing of another embodiment of the invention having a pair of variable resilient means for varying the flexibility of a ski.

FIG. 15 is a schematic drawing of another embodiment of the invention having pairs of additive variable resilient means for varying the flexibility of a ski. In this embodiment, a stiffness control assembly 101 includes an engagement means, which can be a support plate 103, whose ends 109 and 109' are free ends which can slide in the longitudinal direction of ski 107 within guide means such as support clamps 111 and 111'. Impedance means, designated in the Figure as adjustable stop members 113 and 113' are also shown, the adjustable stop members being movable relative to plate 103 and ski 107 within clamps 117 and 117', as indicated by arrows 115 and 115'.

When the ski is to retain its bending ability unimpaired, the distance between the adjustable stops 113 and 113' and the free ends 109 and 109' of the support plate 103 is adjusted to have a relatively high value, with no connection therebetween. Then, regardless of the degree of bending of the ski 107, plate 103 cannot engage stops 113 and 113', and no additional stiffness is imposed on the ski by the support plate 103. When, however, it is intended that assembly 101 minimize the bending of the ski, as for example when the ski is to be turned in hard snow, adjustable stops 113 and 113' are set to become engaged with the free ends 109 and 109' of support plate 103 to a greater or lesser degree of bending of the ski so that there is interaction between the stops 113 and 113' and the ends 109 and 109', the extent of the adjustment selected being dependent upon the snow conditions which determines the rigidity of the ski desirable under the circumstances.

For example, in a position of intermediate rigidity, a first of the resilient means for reducing the flexibility of the skis is engaged. This is represented by the initial engaging connection between adjustable stop members 113 and 113' and support plate 103 which would result from the connection of the stop members and the ends 109 and 109' through springs R. As the ski undergoes more bending, however, the second of the resilient means is engaged, such additionally imposed rigidity being represented by the movement of support plate 103 to a position at which its ends 109 and 109' also contacts springs R', thus imposing the rigidity effect of both springs upon the connections.

Various systems for controlling the stiffness of a ski have been described above. The skier may manually, or perhaps with the ski pole or some other device, adjust the apparatus according to the type of stiffness to be desired. In the last embodiment, this adjustment is made by the apparatus itself. The skier need not have different skiing apparatus for different types of snow or different abilities of the skier, and need not settle for a ski-binding combination which is appropriate for only one type of skiing. Now, the skier need only adjust the apparatus for the type of stiffness desired to participate in the skiing event. The settings can be changed as the skier desires. The invention may further include dampening means for controlling the vibration of the skis. Furthermore, in some embodiments the skier can continuously adjust the stiffness of the ski. Although many embodiments are given, it should be appreciated that other variations will fall within the scope of the invention.

The invention has been described in sufficient detail to enable one skilled in the art to practice the invention, but variations and modifications within the spirit and scope of the invention may occur to those skilled in the art to which the invention pertains.

What is claimed is:

1. A system for changing the stiffness of a ski, the ski having a forward end and a rearward end, said system comprising:

an elongated, substantially rigid engagement member attached to a ski and having active surfaces with a forward facing end surface and a rearward facing end surface, and support means for supporting said engagement member for movement longitudinally relative to said support means and the ski as the ski bends; and adjustable impedance means fixed to the ski and having biasing means operatively engaging said forward facing end surface and adjustable impedance means fixed to the ski and having biasing means operatively engaging said rearward facing end surface, as bending moments are applied to the ski tending to cause the ski to bend, for changing the actual bending of the ski beneath said system, each of said biasing means applying a progressively increasing force to respective ones of said forward and rearward end surfaces as the bending of the ski increases.

2. A system according to claim 1, and further including bias regulating means for controlling the initial amount of force with which said biasing means operatively engages said end surfaces.

3. A system according to claim 1 wherein said biasing means each comprises a spring, and said bias regulating means each comprises a screw for controlling the initial compression of said spring.

4. A system for changing the stiffness of a ski, the ski having a forward end and a rearward end, said system comprising:

an elongated, substantially rigid engagement member having active surfaces with a forward facing end surface and a rearward facing end surface; and first and second adjustable impedance means fixed to the ski and operatively engageable with said forward facing end surface and said rearward facing end surface respectively while permitting relative movement therebetween, each of said first and second adjustable impedance means including a vertically movable adjustment member having frictional engagement means, and biasing means for applying a downward force against said adjustment member for establishing frictional engagement between said frictional engagement means and a respective one of said forward facing end surface and said rearward facing end surface, said adjustment members being movable against the force of said biasing means as the ski bends.

5. A system for changing the stiffness of a ski, the ski having a forward end and a rearward end, said system comprising:

an elongated, substantially rigid engagement member having active surfaces with a forward facing end surface and a rearward facing end surface;

support means for supporting said engagement member for movement longitudinally relative to said support means and the ski as the ski bends;

adjustable biasing means fixed to the ski and in operative engagement with said rearward facing end surface and adjustable biasing means fixed to the ski and in operative engagement with said rearward facing end surface; and first and second stop means spaced a predetermined distance from said forward facing end surface and said rearward facing end surface surface respectively and engageable therewith upon a predetermined bending of said ski.

6. A system according to claim 5 wherein said biasing means and said stop means reduce the longitudinally bending of the ski when the ski is flexing, and increase the longitudinal bending of the ski when the ski is counterflexing.

7. A system for changing the stiffness of a ski, the ski having a forward end and rearward end, said system comprising:

an elongated, substantially rigid engagement member having active surfaces with a forward facing end surface and a rearward facing end surface;

support means for supplying said engagement member for movement longitudinally relative to said support means and the ski as the ski bends;

first and second impedance means fixed to the ski and operatively engageable with said forward facing end surface and said rearward facing end surface respectively, each of said first and second impedance means including first biasing means in engagement with a respective one of said forward and rearward facing end surfaces and second biasing means spaced a predetermined distance from a respective one of said forward and rearward facing end surfaces, said second biasing means being engageable with a respective one of said forward and rearward facing end surfaces upon a predetermined bending of said ski.

8. A system according to claim 7 wherein at least one of said first impedance means and said second impedance means is operatively connected to the ski and to one of said end surfaces to control the flexing and counterflexing of the ski.

* * * * *